US009506638B2

(12) United States Patent
Hannah

(10) Patent No.: US 9,506,638 B2
(45) Date of Patent: Nov. 29, 2016

(54) RAPID DEPLOY MULTI-MOUNT LIGHTING SYSTEM

(71) Applicant: Kevin Wayne Hannah, Tulsa, OK (US)

(72) Inventor: Kevin Wayne Hannah, Tulsa, OK (US)

( * ) Notice: Subject to any disclaimer, the term of this patent is extended or adjusted under 35 U.S.C. 154(b) by 0 days.

(21) Appl. No.: 14/503,353

(22) Filed: Sep. 30, 2014

(65) Prior Publication Data

US 2015/0092430 A1 Apr. 2, 2015

Related U.S. Application Data

(60) Provisional application No. 61/884,777, filed on Sep. 30, 2013.

(51) Int. Cl.

| | |
|---|---|
| ***F21V 21/14*** | (2006.01) |
| ***F21V 21/30*** | (2006.01) |
| ***F21L 14/00*** | (2006.01) |
| ***F21L 14/04*** | (2006.01) |
| ***F21V 21/36*** | (2006.01) |

(52) U.S. Cl.

CPC ..... *F21V 21/145* (2013.01); *F21L 14/00* (2013.01); *F21L 14/04* (2013.01); *F21V 21/36* (2013.01)

(58) Field of Classification Search

CPC ..... F21V 21/36; F21V 21/145; F21L 14/00; F21L 14/04

See application file for complete search history.

(56) References Cited

U.S. PATENT DOCUMENTS

| | | | | |
|---|---|---|---|---|
| 6,019,484 A * | 2/2000 | Seyler | F21L 14/04 | 362/287 |
| 6,299,336 B1 * | 10/2001 | Hulse | B60Q 1/2611 | 362/198 |
| 8,322,877 B1 * | 12/2012 | Merritt | F21L 14/04 | 362/220 |
| 2015/0023017 A1 * | 1/2015 | Smith | F21V 21/22 | 362/249.03 |

* cited by examiner

*Primary Examiner* — Thomas M Sember

(74) *Attorney, Agent, or Firm* — Hall Estill Law Firm; Robert P. Fitz-Patrick

(57) ABSTRACT

A lighting system capable of rapid deployment for use in vehicular and non-vehicular deployment scenarios to project light as and where needed. The lighting system comprises an interchangeable mounting apparatus which is configured for the particular deployment application, which can be vehicular or non-vehicular. The mounting apparatus connects to a rapidly vertically deployable mast system, which can be folded to facilitate transport and storage. A lighting assembly is attached to the mast system on movable brackets. A broad range and class of lighting components may be selected for attachment to the mast system, and the mast system vertically deploys to facilitate the projection of light as desired.

27 Claims, 6 Drawing Sheets

RAPID DEPLOY MULTI-MOUNT LIGHTING SYSTEM

RELATED U.S. APPLICATIONS

Provisional Application 61/884,777, filed on Sep. 30, 2013

BACKGROUND OF THE INVENTION

The present invention relates to lighting systems, and more particularly to a versatile lighting system capable of rapid deployment, which may be mounted on a vehicle or tripod or be deployed in other vehicular and non-vehicular configurations and which may be used for various lighting and related functions and applications.

Historically, lighting units designated as portable have had limited flexibility, in terms of their level of portability, mounting options and functional options. Such lighting units have often been associated with vehicles, often being trailer mounted or used in connection with other methods of transport. Historically, lighting units mounted on vehicles have had limited versatility in mounting options, and that lack of versatility has limited the deployment abilities and utility of such lighting units. Also, purportedly portable lighting units have lacked the ability to deploy in non-vehicular fixed mounting arrangements. Moreover, such lighting units have had limited flexibility in terms of their ability to provide maximum effective lighting and related applications for a broad variety of situations It is believed that the present invention is not described by, and overcomes limitations of, prior art lighting units. The flexibility of the rapid deploy multi-mount lighting system, both in terms of vehicular and non-vehicular mounting options and functional lighting and related applications, solves problems inherent in and offers significant advantages over the prior art.

SUMMARY OF THE INVENTION

The portable lighting system of the present invention is an enhanced rapid deploy portable lighting system which can be configured for preselected vehicle and non-vehicle mounting applications to provide lighting and related applications for a broad spectrum of safety, work and recreational uses. The rapid deploy lighting system uses interchangeable mounting apparatuses which allow the unit to be rapidly set up and attached in a variety of deployments, including vehicular and non-vehicular applications. The rapid deploy multi-mount lighting system can be deployed and mounted in various configurations. The rapid deploy multi-mount lighting system can be mounted on a vehicle such as a truck with a bed and tailgate in various configurations, including for example mounting through a trailer receiver or the truck side wall pocket using varied mounting apparatuses that allow the unit to connect with various vehicular interfaces. The rapid deploy multi-mount lighting system can be deployed on a trailer or in non-vehicle deployment configurations, such as mounting on a pedestal or tripod, using mounting apparatuses which allow the lighting system to interface with the chosen deployment method. The rapid deploy multi-mount lighting system can be powered in various ways, increasing its versatility.

The method of deployment of the rapid deploy multi-mount lighting system is facilitated by a mounting apparatus, which can vary with the deployment method chosen. That mounting apparatus is attached to a hinge or other assembly that allows the unit to be adjusted to various positions of deployment, for transport, access and storage. That assembly is attached to a mast assembly, the upper and lower sections of which are joined by a hinge or other assembly which allows the mast assembly to collapse for storage and transport. The upper and lower sections of the mast assembly when fully extended form a multi-functional light tower. The upper mast section may be erected by hand, or by use of a gas piston device or by a device which telescopically raises the upper shaft or by other means which facilitate raising the unit. A crossbar is attached to the mast, upon which LED light engines or other units capable of projecting light may be placed and used to provide light for a variety of applications. Given the functional flexibility of the current invention, the rapid deploy multi-mount lighting system can be used for other light and related applications. These and other features of the present invention will be readily apparent from the description and drawings which follow.

BRIEF DESCRIPTION OF THE DRAWINGS

FIG. 1 is a perspective view of the rapid deploy multi-mount lighting system of the present invention;

DETAILED DESCRIPTION OF THE INVENTION

Figure 1A:
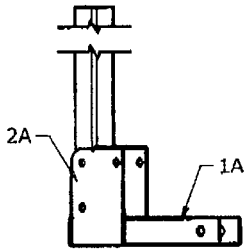
FIG. 1*a* is a perspective view of the mounting apparatus configured to connect to tubular mounting applications with a square cross-section.
Figure 1B:
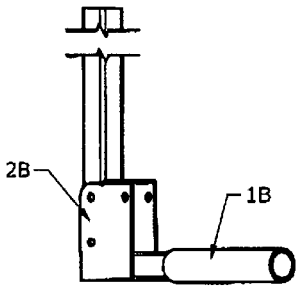
FIG. 1*b* is a perspective view of the mounting apparatus configured to connect to tubular mounting applications with a circular cross-section
Figure 1C:
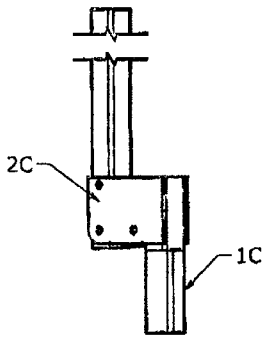
FIG. 1*c* is a perspective view of the mounting apparatus configured to connect to a truck with a bed and tailgate, into the side pocket of a truck bed rail.
Figure 1D:
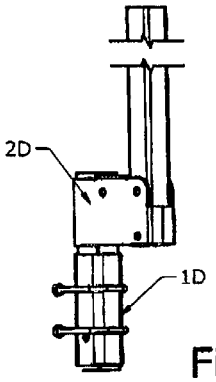
FIG. 1*d* is a perspective view of the mounting apparatus configured to connect to a clamp attachment mount (as pictured, with U-bolts).
Figure 1E:
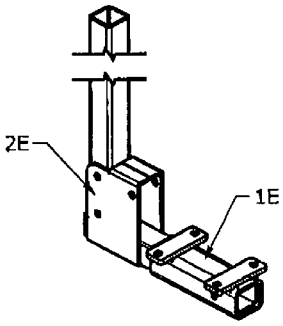
FIG. 1*e* is a perspective view of the mounting apparatus configured to connect to an undercarriage slide attachment mount (as pictured, with mounting plates).
Figure 1F:
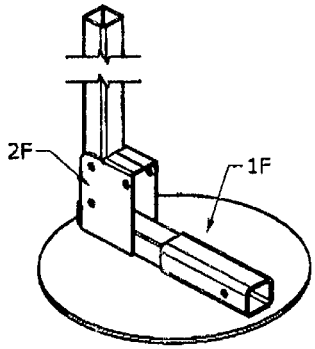
FIG. 1*f* is a perspective view of the mounting apparatus configured to connect to a pedestal mount.
Figure 1G:
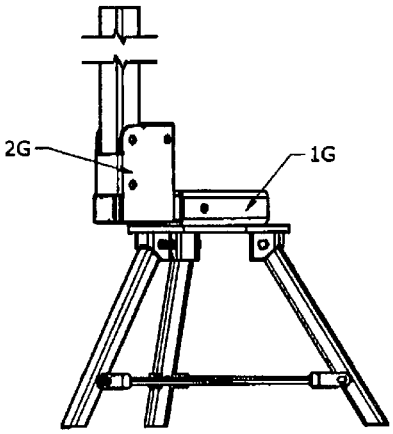
FIG. 1*g* is a perspective view of the mounting apparatus configured to connect to a tripod mount.

The present invention is a portable rapid deploy multi-mount lighting system, with multiple lighting and related functionalities and multiple potential mounting configurations, including vehicle mounting and non-vehicle mounting configurations, which is depicted in the drawings. The rapid deploy multi-mount lighting system has a variety of potential lighting and related applications for work, safety, and recreational related uses. The rapid deploy portable multi-mount lighting system can be deployed and mounted on a vehicle such as a truck with a bed and tailgate in various configurations, including for example through the trailer receiver or the truck side wall pocket by means of various mounting apparatuses. The portable rapid deploy multi-mount lighting system can be deployed and mounted on a trailer, on a tripod, and in various other configurations via various mounting apparatuses The rapid deploy portable multi-mount lighting system offers improvements over currently existing lighting units.

Figure 2:
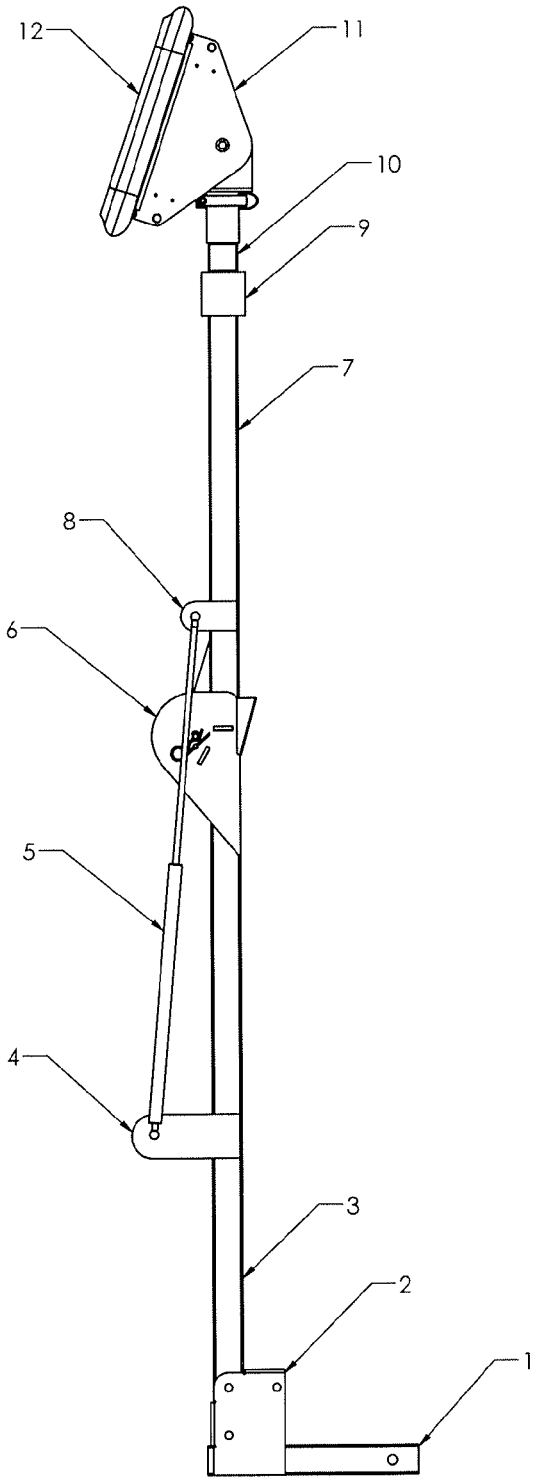
FIG. 2 is a side view of the rapid deploy multi-mount lighting system of the present invention.
Figure 3:
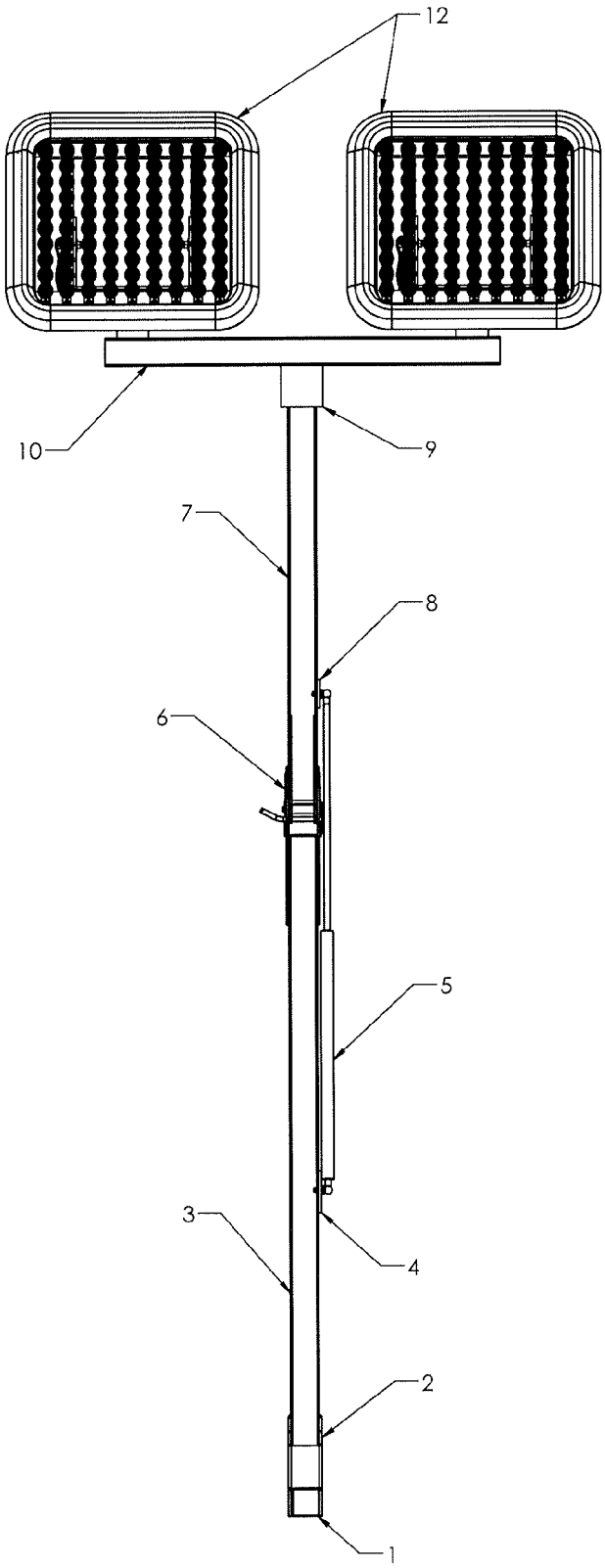
FIG. 3 is a front view of the rapid deploy multi-mount lighting system of the present invention.
Figure 4:
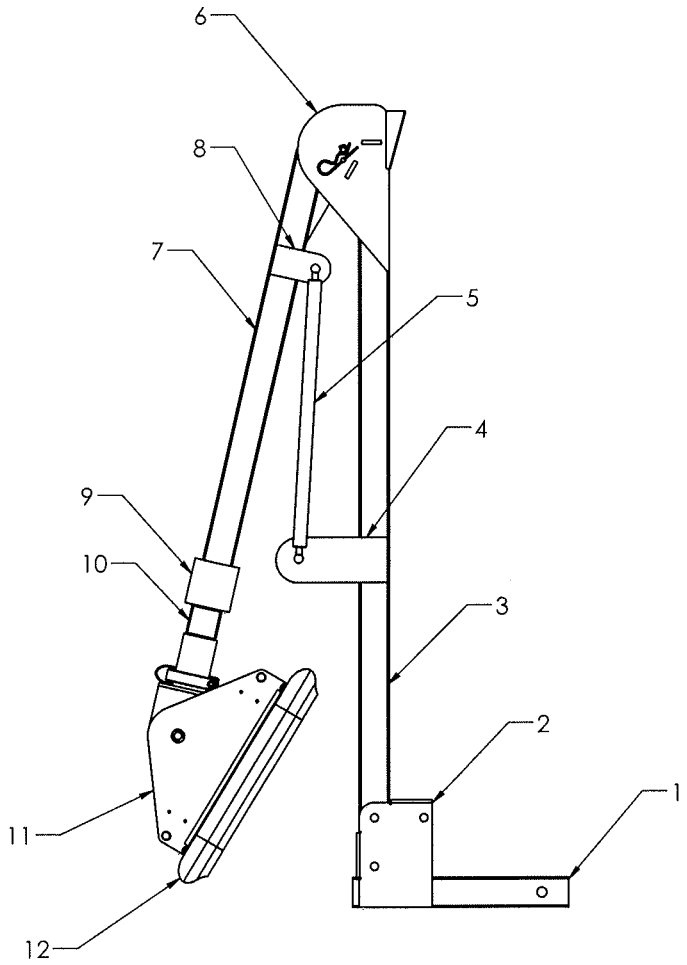
FIG. 4 is a side view of the rapid deploy multi-mount lighting system of the present invention, with the mast assembly folded for deployment, transport, access or storage.
Figure 5:
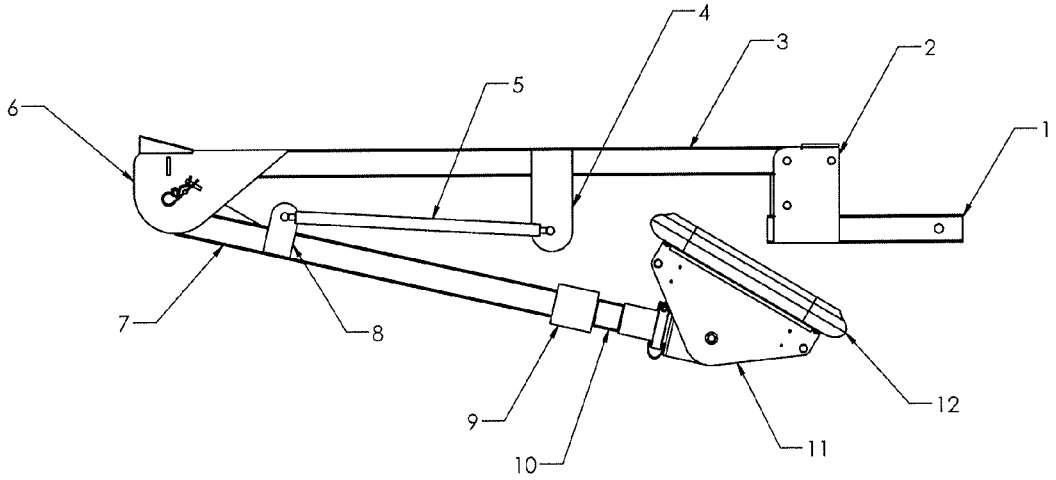
FIG. 5 is a side view of the rapid deploy multi-mount lighting system of the present invention, with both the mast assembly and lower mast section folded for transport, access and storage.

Referring to FIGS. 1-3, the rapid deploy multi-mount lighting system comprises a mounting apparatus 1 which allows the lighting system to be mounted in various configurations, including vehicle and non-vehicle mounting configurations. As pictured, the lighting system unit would mount in a variety of vehicular and non-vehicular applications such as a trailer receiver, although many mounting options are possible using Mounting Apparatus 1 or functional equivalents thereof including apparatuses for ground deployment. Mounting Apparatus 1 connects to Lower Hinge Assembly 2, which in turn connects to Lower Mast Section 3. As pictured, Lower Gas Spring Assist Bracket 4 is attached to Lower Mast Section 3. Gas Spring Assist 5 connects to Lower Gas Spring Assist Bracket 4. Lower Mast Section 3 connects to Upper Hinge Assembly 6. Upper Mast Section 7 connects to Upper Hinge Assembly 6. Upper Gas Spring Assist Bracket 8 attaches to Upper Mast Section 7 and Gas Spring Assist 5. Crossbar Fitting 9 attaches to Upper Mast Section 7. Crossbar 10 attaches to Crossbar Fitting 9, which attachment may result in Crossbar 10 being fixed or movable in various directions depending upon the functional application of the lighting system. Crossbar 10 may also attach directly to Upper Mast Section 7 by welding or other similar process. Mounting Brackets 11, which may be fixed or movable in various directions depending upon the functional application of the lighting system, attach to Crossbar 10. As pictured, the lighting assembly LED Light Engine 12 attaches to Mounting Brackets 11, although various lighting and lighting related apparatus and configurations may be attached to Mounting Brackets 11 or Crossbar 10. Power may be supplied to the LED Light Engine 12 by electrical wiring (not pictured for clarity) which may run from the lighting or lighting-related apparatus, in, through, around or near the rapid deploy multi-mount lighting system assembly in various configurations, to connect with various vehicle-supplied and other potential power sources.

Referring to FIGS. 1-3, the rapid deploy multi-mount lighting system may have a different Mounting Apparatus 1 for various mounting and deployment configurations, and those skilled in the art can determine the appropriate mounting apparatus depending on the deployment application. Mounting Apparatus 1 in its various functional equivalents will allow the system to be deployed in several configurations, including but not limited to a mounting apparatus for any tubular mounting application with any shape of cross-section, including but not limited to a square cross section, as well as a truck trailer receiver mount, a truck side wall pocket mount, a clamp attachment mount, an undercarriage slide attachment mount, a pedestal mount, a tripod mount, among other potential deployment options. FIGS. 1*a*-1*g* present various potential configurations for Mounting Apparatus 1. FIGS. 1, 2, 3, 4, 5, 6*a* and 6*b* present the lighting system configured for mounting in a vehicle hitch receiver, one of many potential deployments for the system.

Regardless of which mounting apparatus is used, Mounting Apparatus 1 connects to Lower Hinge Assembly 2 which connects to Lower Mast Section 3. Under normal operating conditions, Lower Hinge Assembly 2 forms an approximately 90 degree angle between Mounting Apparatus 1 and Lower Mast Section 3. Lower Hinge Assembly 2 can be adjusted so that Lower Mast Section 3 may be folded (as pictured in FIG. 5) for deployment, transport, access or storage. Lower Mast Section 3 connects to Upper Hinge Assembly 6 which connects to Upper Mast Section 7. Upper Hinge Assembly 6 can be adjusted so that Upper Mast Section 7 can fold toward Lower Mast Section 3 (as pictured in FIG. 4).

The pictured configuration has Lower Gas Spring Assist Bracket 4 attached to Lower Mast Section 3. Upper Gas Spring Assist Bracket 8 attaches to Upper Mast Section 7. Gas Spring Assist 5 is attached to Upper Gas Spring Assist Bracket 8 and Lower Gas Spring Assist Bracket 4. Gas Spring Assist 5 assists with vertical deployment of the Upper Mast Section 7. Crossbar 10 attaches to Upper Mast Section 7 via either Crossbar Fitting 9 which may result in a fixed or movable crossbar, or directly, which direct attachment may be accomplished by welding or similar process. The Mounting Brackets 11 may be fixed or movable in various directions and facilitate mounting of lighting configurations and related applications. While lighting assembly LED Light Engine 12 is pictured attached to the mounting brackets, many other lighting configurations and related applications may be attached to the Mounting Brackets 11 or Crossbar 10. As with the Mounting Apparatus 1, the configuration of Mounting Brackets 10 may vary with the lighting or other application chosen, and those skilled in the art can determine the appropriate mounting apparatus depending on the functional application.

The wiring to power LED Light Engine 12 can be threaded or run through, in, around or near the rapid deploy multi-mount lighting system. Those skilled in the art can determine the appropriate wiring configuration based on the lighting or other application and potential power sources. The rapid deploy multi-mount lighting system can draw power from several sources, including 12 VDC, 120 VAC, 277 VAC, solar power, battery power, and other sources of power. The rapid deploy multi-mount lighting system can also incorporate the ability to function as a workstation to power other equipment.

Figure 6A:
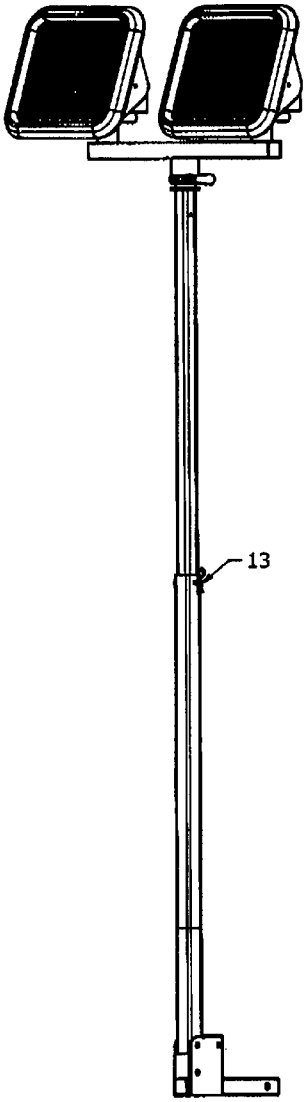
FIG. 6*a* is a perspective view of the rapid deploy multi-mount lighting system with the mast assembly fully deployed after telescoping the upper mast section from the inside of the lower mast section (as pictured, the upper mast section is held in place when fully deployed by a locking pin and clip).
Figure 6B:
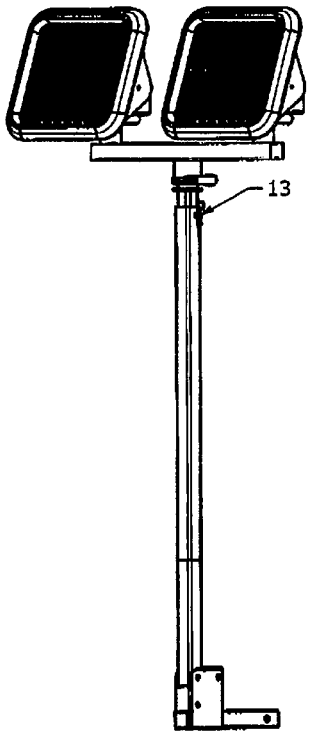
FIG. 6*b* is a perspective view of the rapid deploy multi-mount lighting system with the upper mast section inside the lower mast section for deployment, transport, access or storage.

As for materials used to construct the rapid deploy multi-mount lighting system, it can made of steel, or any metal capable of being manufactured in the proper configuration. Lighter metals such as aluminum could be used to construct the rapid deploy multi-mount lighting system, which would increase its portability. Fiberglass or carbon fiber construction is also possible, and would also increase portability or the system. The construction of the rapid-deploy multi-mount lighting system can be accomplished by other means as well, known to those skilled in the art. As for the gas spring assist, other methods may be used to deploy the upper mast section, including by use of a telescoping means wherein the upper mast section is deployed from within the lower mast section. FIG. 6*a* presents the lighting system filly deployed after manual telescoping of the upper mast section from within the lower mast section, in which, as pictured, the upper mast section is locked in place with a pin and clip assembly 13, which assembly may be removed to retract the upper mast section from its fully deployed position into the lower mast section for storage, transport and access, as presented in FIG. 6*b*. The deployment of the upper mast section can be accomplished by other means as well, known to those skilled in the art.

As described herein, there are several alternate embodiments of the rapid deploy multi-mount lighting system beyond the embodiment pictured in the figures. The myriad various deployment options which may be accomplished using functional equivalents of Mounting Apparatus 1 described herein are embodiments within the scope of the present invention.

The scope of the present invention also includes multiple application functionalities in addition to the LED Light Engine 12 pictured. The system can be configured for flood illumination, spot illumination, and area illumination. Other possible applications include low bay reflector kits, work light/flashlight kits, and various power station options (including 10-30 VDC and USB). Other types of light applications may also be used. Other lighting-related applications of the system include a camera mount option. Further, an umbrella mount could deflect rain and effectively create a work station, with flood/spot lighting built in to the umbrella mount (which could be configured with integrated up-light lighting equipment providing area and work station illumination). The crossbar assembly can be attached in a manner such that it rotates, which, combined with mounting brackets which may be fixed or move independently of the crossbar, allows increased lighting application flexibility.

Advantages of the rapid deploy portable multi-mount lighting system over prior art lighting units include but are not limited to the following: the system is compact and lightweight; the system is easily portable; the system does not require a trailer for transport; the system does not require a generator for power; the system can be transported when mounted to a vehicle; the system can be easily adjusted and aimed in all directions; the rapid deploy characteristic of the system reduces setup time; the system is flexible in that it will deploy in a number of varied configurations and mountings; the system can fold into a compact configuration for transport or storage; the system mast can be extended by gas spring assist or by telescoping or other means; the system can be powered several ways, including via 12 VDC standard trailer plugs; 120V/277V AC, or solar power; the system is energy efficient; the system is versatile and can be used as spot, flood or area light; the system can be used with multiple optic configurations.

While the foregoing written description of the invention enables one of ordinary skill in the art to make and use what is considered presently to be the best mode thereof, those of ordinary skill in the art will understand and appreciate the existence of variations, combinations, and equivalents of the specific embodiments, methods, and examples herein. The invention should therefore not be limited by the above described embodiments, methods, and examples, but by all embodiments and methods within the scope and spirit of the invention.

What is claimed is:

1. A rapid deploy multi-mount lighting system, comprising a mounting apparatus configured to allow rapid deployment of the lighting system for preselected vehicular and non-vehicular deployment scenarios, with a first end and a second end, with the first end configured to facilitate mounting the system in the chosen preselected deployment scenario, and the second end configured to allow connection of the mounting apparatus to a mast system for rapid vertical deployment of the lighting system;

a mast system for rapid vertical deployment of the lighting system, comprising:

(a) a lower mast hinge assembly having lower and upper ends, the lower end of which connects to the second end of said mounting apparatus, which lower hinge assembly allows rotation of the lower mast section from its vertical deployment configuration to facilitate transport, access and storage;

(b) a lower mast section having lower and upper ends, the lower end of which connects to the upper end of said lower hinge assembly;

(c) an upper mast hinge assembly having lower and upper ends, the lower end of which connects to the upper end of said lower mast section, which upper mast hinge assembly allows rotation of the upper mast section from its vertical deployment configuration towards the lower mast section to facilitate transport, access and storage;

(d) an upper mast section having lower and upper ends, the lower end of which connects to the upper end of said upper mast hinge assembly (e) a crossbar connected to said upper mast section, perpendicular to the upper mast section and centered on the vertical axis of the upper mast section;

(f) mounting brackets capable of rotation connected to said crossbar symmetrically with respect to the vertical axis of the upper mast section;

(g) a lighting assembly for projecting light connected to said mounting brackets; and a means for transmission of electrical power to said lighting system.

2. The rapid deploy multi-mount lighting system of claim 1, wherein a gas spring assist piston with upper and lower ends is attached to the mast system by connecting its lower end a bracket attached to the lower mast section and connecting its upper end to a bracket attached to the upper mast section.

3. The rapid deploy multi-mount lighting system of claim 1, wherein a rotatable fitting is connected to the upper end of the upper mast section, and the crossbar of the upper mast section is connected to said rotatable fitting, perpendicular to the upper mast section and centered on the vertical axis of the upper mast section.

4. The rapid deploy multi-mount lighting system of claim 1, wherein the first end of the mounting apparatus is configured to connect to tubular mounting applications with a square cross section.

5. The rapid deploy multi-mount lighting system of claim 1, wherein the first end of the mounting apparatus is configured to connect to tubular mounting applications with a circular cross section.

6. The rapid deploy multi-mount lighting system of claim 1, wherein the first end of the mounting apparatus is configured to connect to a truck with a bed and tailgate, into the side pocket of the truck bed rail.

7. The rapid deploy multi-mount lighting system of claim 1, wherein the first end of the mounting apparatus is configured to connect to a clamp attachment mounting application.

8. The rapid deploy multi-mount lighting system of claim 1, wherein the first end of the mounting apparatus is configured to connect to an undercarriage slide attachment mounting application.

9. The rapid deploy multi-mount lighting system of claim 1, wherein the first end of the mounting apparatus is configured to connect to a pedestal mount.

10. The rapid deploy multi-mount lighting system of claim 1, wherein the first end of the mounting apparatus is configured to connect to a tripod mount.

11. The rapid deploy multi-mount lighting system of claim 1, wherein the lighting assembly is an LED Light Engine configured for a preselected lighting application.

12. The rapid deploy multi-mount lighting system of claim 1, wherein the lighting assembly is a non-LED source configured or a preselected lighting application.

13. The rapid deploy multi-mount lighting system of claim 1, wherein the crossbar is capable of rotation around the vertical axis of the upper mast section.

14. The rapid deploy multi-mount lighting system of claim 1, wherein the mounting brackets rotate multi-directionally to the extent that light can be projected in any direction or multiple directions as required by the particular lighting application.

15. A rapid deploy multi-mount lighting system, comprising a mounting apparatus configured to allow rapid deployment of the lighting system for preselected vehicular and non-vehicular deployment scenarios, with a first end and a second end, with the first end configured to facilitate mounting the system in the chosen preselected deployment scenario, and the second end configured to allow connection of the mounting apparatus to a mast system for rapid vertical deployment of the lighting system;

a mast system for rapid vertical deployment of the lighting system, comprising:

(a) a lower mast hinge assembly having lower and upper ends, the lower end of which connects to the second end of said mounting apparatus, which lower hinge assembly allows rotation of the lower mast section from its vertical deployment configuration to facilitate transport, access and storage;

(b) a lower mast section having lower and upper ends, the lower end of which connects to the upper end of said lower hinge assembly;

(c) an upper mast section having lower and upper ends, which in its undeployed configuration is contained within the lower mast second;

(d) a telescoping means for the vertical extension and retraction of the upper mast section;

(e) a crossbar connected to said upper mast section, perpendicular to the upper mast section and centered on the vertical axis of the upper mast section;

(f) mounting brackets capable of rotation connected to said crossbar symmetrically with respect to the vertical axis of the upper mast section;

(g) a lighting assembly for projecting light connected to said mounting brackets; and a means for transmission of electrical power to said lighting system.

16. The rapid deploy multi-mount lighting system of claim 15, wherein a rotatable fitting is connected to the upper end of the upper mast section, and the crossbar of the upper mast section is connected to said rotatable fitting, perpendicular to the upper mast section and centered on the vertical axis of the upper mast section.

17. The rapid deploy multi-mount lighting system of claim 15, wherein the first end of the mounting apparatus is configured to connect to tubular mounting applications with a square cross section.

18. The rapid deploy multi-mount lighting system of claim 15, wherein the first end of the mounting apparatus is configured to connect to tubular mounting applications with a circular cross section.

19. The rapid deploy multi-mount lighting system of claim 15, wherein the first end of the mounting apparatus is configured to connect to a truck with a bed and tailgate, into the side pocket of the truck bed rail.

20. The rapid deploy multi-mount lighting system of claim 15, wherein the first end of the mounting apparatus is configured to connect to a clamp attachment mounting application.

21. The rapid deploy multi-mount lighting system of claim 15, wherein the first end of the mounting apparatus is configured to connect to an undercarriage slide attachment mounting application.

22. The rapid deploy multi-mount lighting system of claim 15, wherein the first end of the mounting apparatus is configured to connect to a pedestal mount.

23. The rapid deploy multi-mount lighting system of claim 15, wherein the first end of the mounting apparatus is configured to connect to a tripod mount.

24. The rapid deploy multi-mount lighting system of claim 15, wherein the lighting assembly is an LED Light Engine configured for a preselected lighting application.

25. The rapid deploy multi-mount lighting system of claim 15, wherein the lighting assembly is a non-LED source configured or a preselected lighting application.

26. The rapid deploy multi-mount lighting system of claim 15, wherein the crossbar is capable of rotation around the vertical axis of the upper mast section.

27. The rapid deploy multi-mount lighting system of claim 15, wherein the mounting brackets rotate multi-directionally to the extent that light can be projected in any direction or multiple directions as required by the particular lighting application.

* * * * *